US005273305A

United States Patent [19]

Erdei et al.

[11] Patent Number: 5,273,305

[45] Date of Patent: Dec. 28, 1993

[54] SKI AND SKI-BINDING COMBINATION

[75] Inventors: Roland Erdei, Weigelsdorf; Alois Himmetsberger, Vienna; Klaus Hoelzl, Vienna; Reinhold Wawra, Vienna; Gottfried Steiner, Knittelfeld/Weyern; Engelbert Spitaler, Wr. Neudorf, all of Austria

[73] Assignee: HTM Sport- und Freizeitgeraete Gesellschaft m. b. H., Schwechat, Austria

[21] Appl. No.: 803,481

[22] Filed: Dec. 4, 1991

[30] Foreign Application Priority Data

Dec. 14, 1990 [AT] Austria ..... 2549/90

[51] Int. Cl.[5] ..... A63C 5/04

[52] U.S. Cl. ..... 280/617; 280/633

[58] Field of Search ..... 280/633, 636, 617, 607, 280/601, 618

[56] References Cited

U.S. PATENT DOCUMENTS

| | | | |
|---|---|---|---|
| 3,790,186 | 2/1974 | Kanno | 280/617 |
| 4,747,613 | 5/1988 | Brichoud | 280/611 |
| 5,016,901 | 5/1991 | Mayr | 280/607 |
| 5,056,808 | 10/1991 | Holzl et al. | 280/617 |

*Primary Examiner*—David M. Mitchell

*Attorney, Agent, or Firm*—Flynn, Thiel, Boutell & Tanis

[57] ABSTRACT

A ski and ski-binding combination. The ski has several holes for receiving therein fastening screws for the selective fastening of ski-binding elements arranged in the ski in the binding-installation area. The holes are covered, however, are marked to the outside by markings. The arrangement of holes for the ski-binding elements is adjusted to the length of the ski and chosen such that the ski bindings are suited to receive only a limited number of successive ski-boot sizes.

9 Claims, 2 Drawing Sheets

SKI AND SKI-BINDING COMBINATION

FIELD OF THE INVENTION

The invention relates to a ski and ski-binding combination.

BACKGROUND OF THE INVENTION

Such a ski and ski-binding combination is known for example from AT-PS 288 929. This patent suggests to put holes into the ski already during the manufacture of the ski for fastening screws to effect selective fastening of any desired ski-binding parts thereto and to cover the holes with a surface layer on the ski or the like. It is thus possible that the ski binding installer installs the ski binding directly to the ski without first having to drill holes. A similar solution is shown in DE-OS 37 05 507 (corresponding to U.S. Pat. No. 4,747,613).

These known solutions have not been successful in practice, because a large number of holes is needed to accommodate the selective installation of any desired ski-binding parts for various boot sizes on a ski. Often, very little material thickness remains between the individual holes because of the different hole patterns for the various types of ski-bindings. This significantly weakens the ski in the area of installation of the ski binding, which has, on the one hand, a negative effect on the skiing characteristics and can, on the other hand, result in break fractures in the ski.

SUMMARY OF THE INVENTION

The purpose of the invention is to solve this problem and to provide a ski and ski-binding combination of the above-mentioned type such that the ski is weakened as little as possible and the work for the ski-binding installer is still made easier. Furthermore, the holes are arranged such that as few holes as possible are sufficient.

These purposes are attained according to the invention by arranging the holes in accordance with the length of the ski so that the elements of the ski binding are suited to selectively receive only a limited number of successive ski-boot sizes. Due to the fact that the holes are arranged such that the ski binding is suited to receive only a limited number of ski-boot sizes, it is possible to make do with a small number of holes. The skis are in this manner weakened as little as possible by the holes.

A particularly favorable design of the ski and ski-binding combination of the invention results when the holes are arranged, starting out from a medium length ski-boot sole, such that the ski bindings and ski-binding elements thereof are suited to receive ski boots, the length of the sole of which deviates approximately ±20 to ±40 mm, preferably approximately ±30 mm from a medium length. Due to the fact that a separate row of holes is associated with each fastening screw of each ski-binding element, the unavoidable weakening of the ski is lessened further.

BRIEF DESCRIPTION OF THE DRAWINGS

Further advantages and details will now be described in connection with the drawings, in which.

DETAILED DESCRIPTION

Figure 1:
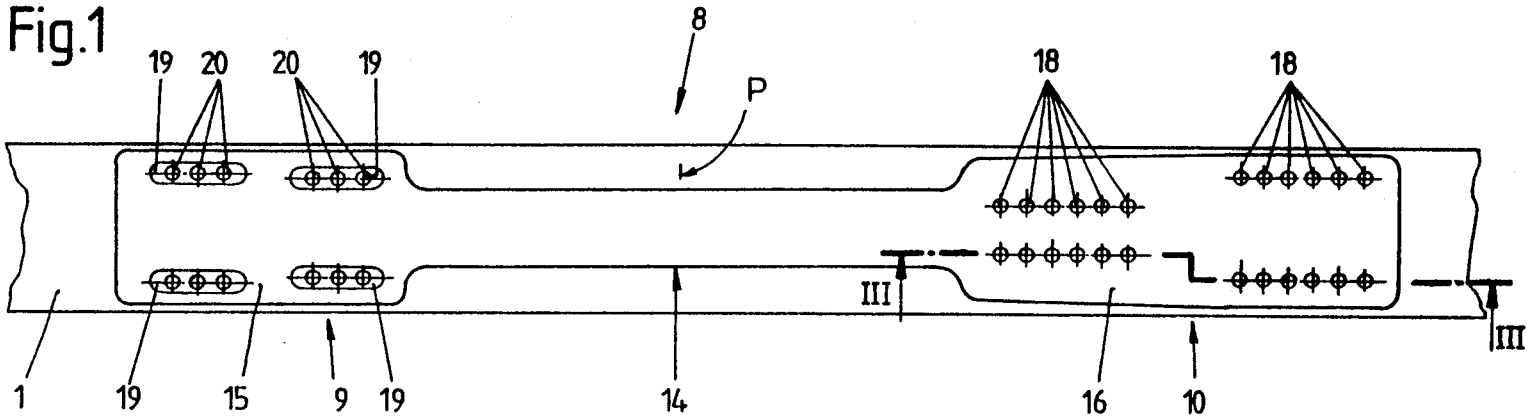
FIG. 1 is a top view of a ski embodying the invention.

FIGS. 1 to 4 show a section of a ski 1 having a core 2, an upper surface layer 3 and a lower surface layer 7. Each of the surface layers 3, 7 can consist conventionally of several layers. The upper surface layer 3 in the illustrated exemplary embodiment (see in particular FIG. 4) consists of a metal layer 4, a laminate 5 and a top layer 6. In a binding-installation area 8 on the ski 1, there are arranged on the upper side 11 of the ski a front set of holes 12 for a front jaw 31 and a rear set of holes 13 for a heel holder 34 of a ski binding 30 designed in a conventional manner. The ski binding 30 has furthermore a connecting element 32 and a ski brake 33 and is equipped with fastening screws 35*a*, 35*b*, 36*a*, 36*b*. The upper side 11 of the ski in the binding-installation area 8 is covered partly with a foil 14. As can be recognized in FIG. 4, the foil 14 in this exemplary embodiment is fastened to the upper side 11 of the ski 1 by means of a double-faced adhesive tape 17. Of course, it would also be possible to glue the foil 14 onto the upper side 11 of the ski 1 with a suitable adhesive. The foil 14 has a front foil area 15 and a rear foil area 16. It has furthermore markings 18 identifying the rear set of holes 13 lying therebelow. The markings 18 are here designed as dimple-like recesses. The markings could also be simply printed on the foil 14. The ski 1 has in the front installation area 9 of the front jaw 31 a binding-damping system, which, however, is not part of the subject matter of the present invention. The binding-damping system has spacer elements 19 among others, which spacer elements 19 cover the front holes 12 lying therebelow, carry markings 20 to characterize the front holes 12 lying therebelow and serve as a support surface for the front jaw 31. The front foil 15 has furthermore markings (not illustrated in the drawings) to characterize the respectively installable boot-sole length.

Figure 2:
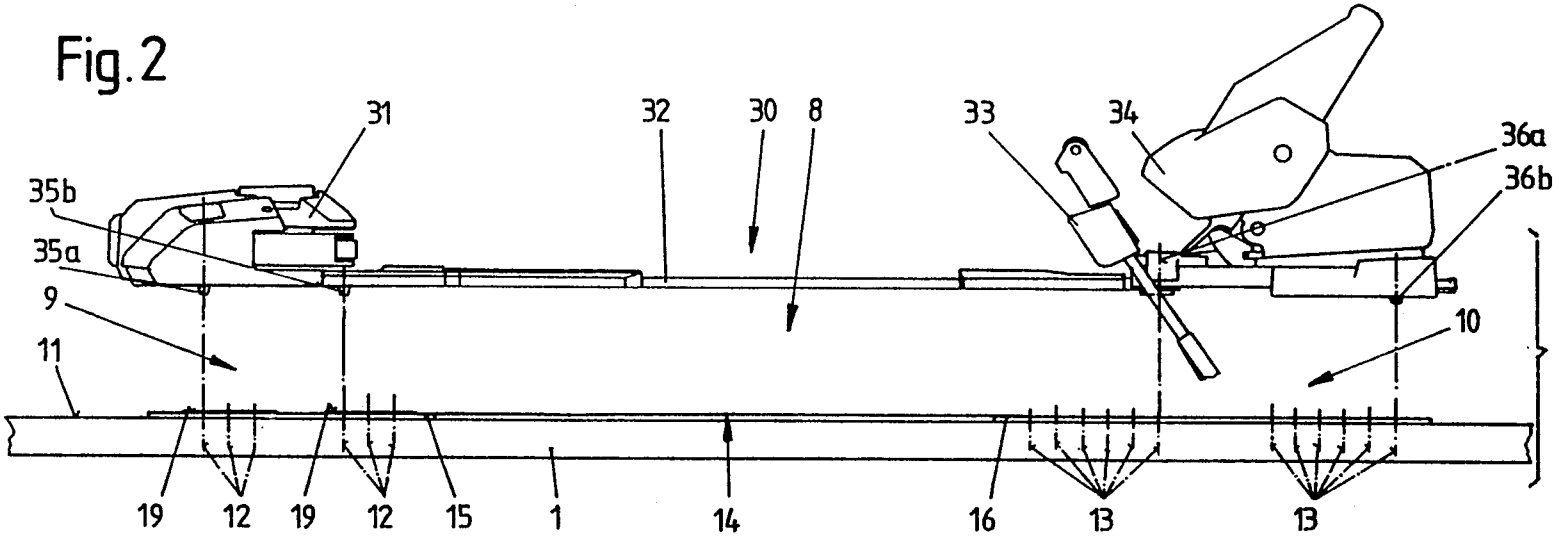
FIG. 2 is a side view of FIG. 1 with the associated ski binding.

FIGS. 1 and 2 show further that a separate row of holes 12, 13 is provided for each set of fastening screws 35*a*, 35*b* of the front jaw 31 and for each set of fastening screws 36*a*, 36*b* of the heel holder 34. The number of holes 12, 13 and their spacing from one another are thereby chosen such that the ski binding 30, starting out from a medium or intermediate ski-boot size adjusted to the respective length of the ski 1, can be installed, the pattern of holes 12, 13 also fitting the next larger and the next smaller ski boot. The entire range of adjustment includes thereby approximately 40–80 mm. Due to the fact that a different number of holes 12, 13 is provided for the front jaw 31 and the heel holder 34, the binding position can be varied further as needed, with only a slight variation in the longitudinal position of the boot-center resulting, namely, a slight deviation of the boot center from the marking point P provided by the ski manufacturer.

Figure 3:
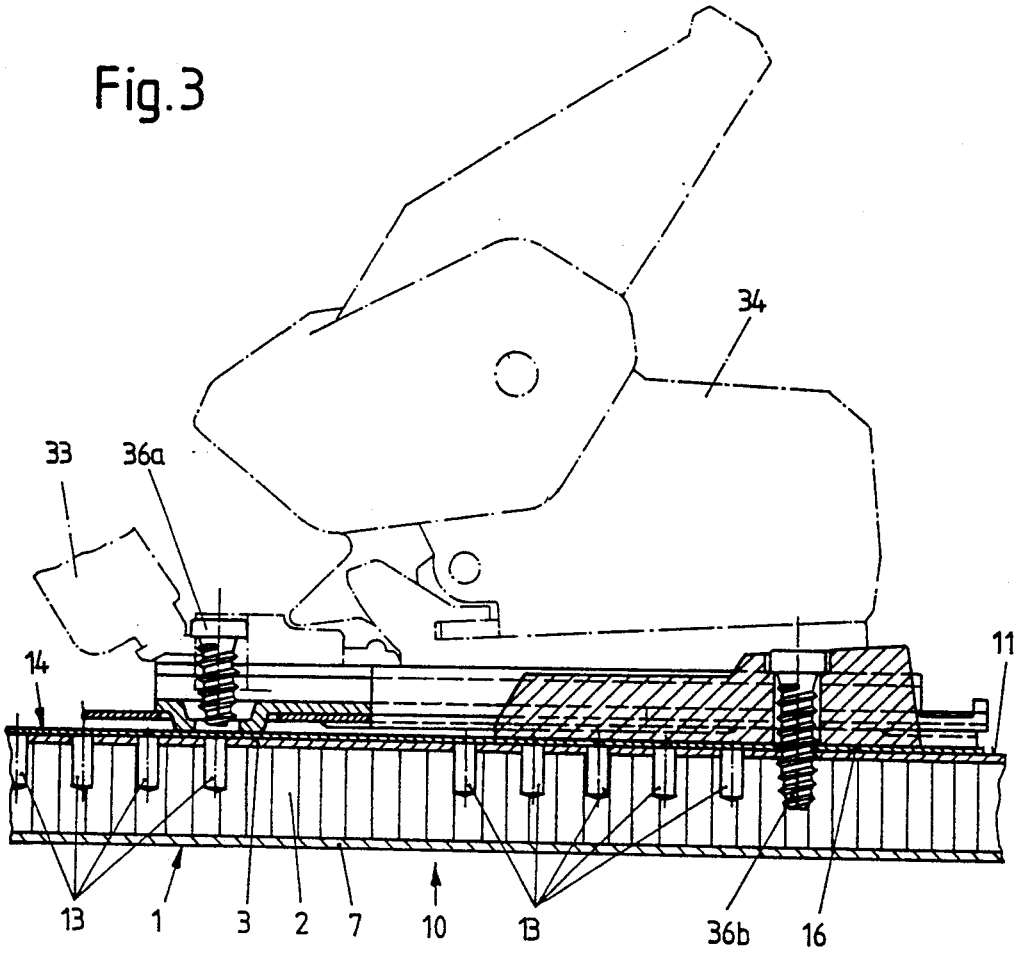
FIG. 3 is a slightly enlarged showing of the heel area of the ski and of the ski binding sectioned partially along the line III—III of FIG. 1.
Figure 4:
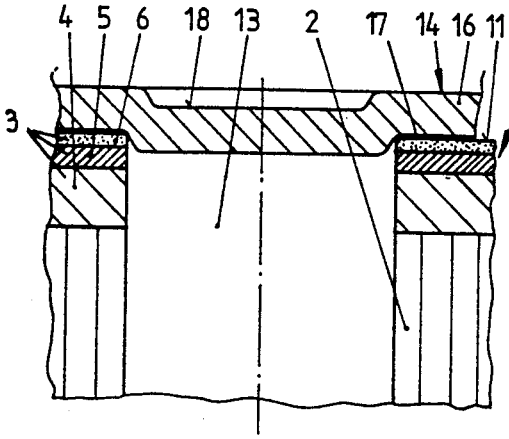
FIGS. 4 and 5 show two modifications of a detail in an enlarged scale.

FIG. 3 shows the rear installation area 10 of the ski with a partially installed heel holder 34. It can thereby be recognized from the drawing that the fastening screw 36*b* extends through the rear foil area 16 during installation, while the holes 13 not used remain closed and thus the core 2 of the ski 1 remains protected against moisture and dirt. The fastening screws 35*a*, 35*b* for the front jaw 31 also extend in a similar manner (not illustrated in detail here) through the respective spacer elements 19.

Figure 5:
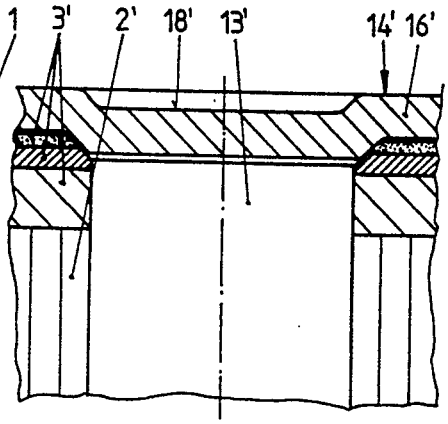

FIG. 5 illustrates a modified embodiment, in which the hole 13' is countersunk. Thus, the correct attachment of the fastening screw is made still easier for the ski-binding installer.

The installer installs the ski binding 30 as follows. He first determines the length of the sole of the boot and connects the front jaw 31 and the heel holder 34 to the connecting element 32 at a suitable distance. The necessary adjusting mechanism of this ski binding is known. He subsequently mounts the front jaw 31 such that the fastening screws 35*a*, 35*b* become aligned with the markings 20 corresponding with the respective boot-sole length. The correct position of the fastening screws 36*a*, 36*b* of the heel holder 34 is thereby automatically obtained by the length of the connecting element 32. Since the markings 18, 20 are recessed, the installer feels immediately whether he correctly mounted the ski binding 30. Thus, the installer is able to immediately tighten the fastening screws 35*a*, 35*b*, 36*a*, 36*b* without any further preparation.

Of course, it is also possible to install conventional ski bindings without any connecting element on the ski embodying the invention if they have the fitting hole pattern. The installer must then, however, determine the position of the heel holder separately for the respective length of the sole of the boot.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski and ski-binding combination, comprising:

means defining a binding-installation area on the ski; and means defining a plurlaity of holes in the binding-installation area, said holes being organized into first and second related patterns for accommodating a limited number of successive spacings between a toe binding and a heel binding of said ski-binding and, consequently, successive ski-boot sizes, each of the plurality of holes being adapted to receive therein a fastening screw used for fastening said toe binding and said heel binding to said ski, said first and second pattern of holes being spaced from one another in a predefined relation on opposite longitudinal sides of a marking point identifying a location for a center of a ski-boot, the spacing between the holes in each of said first and second patterns being such as to facilitate a fastening of said toe binding and said heel binding to selected groupings of said holes in successive spaced relation from one another corresponding to successive ski-boot sizes while simultaneously keeping the center of the ski-boot generally aligned within accepted tolerance with the marking point, said second pattern or holes for said heel binding including twice as many holes as said first pattern of holes for said toe binding.

2. The ski and ski-binding combination according to claim 1, wherein said first and second pattern of holes are spaced from one another a sufficient distance to facilitate a successive and incremental location of said toe binding and said heel binding toward and away from each other to accommodate successive ski-boot sizes in the range of ±20 mm to ±40 mm of a medium length sole of the ski-boot.

3. The ski and ski-binding combination according to claim 1, wherein said first and second hole patterns accommodate successive ski-boot sizes that are ±30 mm of the medium length sole.

4. The ski and ski-binding combination according to claim 1, wherein each of the holes in said first and second hole patterns are covered by a covering member having a center of each hole marked thereon.

5. A ski and ski-binding combination, comprising:

means defining a binding-installation area on the ski; and means defining a plurality of holes in the binding-installation area, said holes being organized into first and second related patterns for accommodating a limited number of successive spacings between a toe binding and a heel binding of said ski-binding and, consequently, successive ski-boot sizes, each of the plurality of holes being adapted to receive therein a fastening screw used for fastening said toe binding and said heel binding to said ski, said first and second pattern of holes being spaced from one another in a predefined relation on opposite longitudinal sides of a marking point identifying a location for a center of a ski-boot, the spacing between the holes in each of said first and second patterns being such as to facilitate a fastening of said toe binding and said heel binding to selected groupings of said hole in successive spaced relation from one another corresponding to successive ski-boot sizes while simultaneously keeping the center of the ski-boot generally aligned within accepted tolerance with the marking point, a common connecting plate and connecting means for facilitating a mounting of said toe binding and said heel binding on said common connecting plate at successively spaced increment to accommodate successive ski-boot sizes, said fastening screws used for fastening said toe binding and said heel binding to the ski also effecting a fastening of the common connecting plate to the ski, said screws each projecting from an underside of said common connecting plate remote from a side on which said toe binding and said heel binding are mounted such that when said screws for said toe binding are oriented in alignment with the holes of said first pattern to orient within tolerance the center of the ski-boot with the marking point on the ski, said projecting screws for said heel binding will be aligned with the holes in said second pattern.

6. The ski and ski-binding combination according to claim 5, wherein said second pattern of holes for said heel binding includes twice as many holes as said first pattern of holes for said toe binding.

7. The ski and ski-binding combination according to claim 5, wherein said first and second pattern of holes are spaced from one another a sufficient distance to facilitate a successive and incremental location of said toe binding and said heel binding toward and away from each other to accommodate successive ski-boot sizes in the range of ±20 mm to ±40 mm of a medium length sole of the ski-boot.

8. The ski and ski-binding combination according to claim 5, wherein said first and second hole patterns accommodate successive ski-boot sizes that are ±30 mm of the medium length sole.

9. The ski and ski-binding combination according to claim 5, wherein each of the holes in said first and second hole patterns are covered by a covering member having a center of each hole marked thereon.

* * * * *

UNITED STATES PATENT AND TRADEMARK OFFICE

CERTIFICATE OF CORRECTION

PATENT NO. : 5 273 305

DATED : December 28, 1993

INVENTOR(S) : Roland ERDEI et al

It is certified that error appears in the above-identified patent and that said Letters Patent is hereby corrected as shown below:

Column 3, line 39; change "plurlaity" to ---plurality---.
line 60; change "or" to ---of---.
Column 4, line 4; change "1" to ---2---.
line 28; change "hole" to ---holes---.
line 36; change "increment" to ---increments---.

Signed and Sealed this

Fourteenth Day of June, 1994

*Attest:*

Bruce Lehman

BRUCE LEHMAN

*Attesting Officer*

*Commissioner of Patents and Trademarks*